US006981684B1

(12) United States Patent
Wadsworth

(10) Patent No.: US 6,981,684 B1
(45) Date of Patent: Jan. 3, 2006

(54) POST SUPPORT APPARATUS WITH ROTATABLE POST GUIDE

(76) Inventor: George William Wadsworth, P.O. Box 879, Dunedin, FL (US) 34697

( * ) Notice: Subject to any disclaimer, the term of this patent is extended or adjusted under 35 U.S.C. 154(b) by 12 days.

(21) Appl. No.: 10/889,509

(22) Filed: Jul. 12, 2004

(51) Int. Cl.
*F16M 13/00* (2006.01)

(52) U.S. Cl. ..... 248/511; 514/530

(58) Field of Classification Search ..... 248/511, 248/514, 515, 517, 520, 521, 534, 535; 269/16, 269/54.1, 54, 56
See application file for complete search history.

(56) References Cited

U.S. PATENT DOCUMENTS 341,090 A * 5/1886 Zanger ..... 248/514
2,755,091 A * 7/1956 Hara ..... 473/274
3,570,793 A * 3/1971 Shackel ..... 248/515
4,093,171 A * 6/1978 Mengo, Sr. ..... 248/515
5,054,737 A * 10/1991 DeLancey ..... 248/515
6,050,020 A * 4/2000 Sizemore ..... 43/15
6,285,339 B1 * 9/2001 McGill ..... 343/882
6,719,261 B2 4/2004 Wadsworth

* cited by examiner

*Primary Examiner*—Kimberly Wood
*Assistant Examiner*—Amy J. Sterling
(74) *Attorney, Agent, or Firm*—Michael E. McKee

(57) ABSTRACT

An apparatus for supporting a metal post while it is being driven into the ground utilizes a platen base and a guide member which is rotatably joined to the base for holding the post in a steady condition while the post is being driven into the ground. Because the guide member is rotatably joined to the base member, the rotational position of a post positioned within the guide member can be significantly altered with respect to the base.

14 Claims, 2 Drawing Sheets

POST SUPPORT APPARATUS WITH ROTATABLE POST GUIDE

BACKGROUND OF THE INVENTION

This invention relates generally to tools and relates, more particularly, to means for use when pounding, or driving, a post into the ground.

In my earlier U.S. Pat. No. 6,719,261, I described an apparatus for supporting a post, such as a metal t-post, which is to be driven into the ground by an individual. Briefly, that apparatus includes a platen base upon which an individual can stand while the post is being driven into the ground, and the base defines a through-opening which is disposed between the feet of the individual when the individual stands upon the base. A cavity-providing guide is mounted upon the base for slidably receiving a post inserted endwise therein and so that the cavity of the guide means is positioned in registry with the through-opening of the base. When an individual stands upon the base with his feet disposed on opposite sides of the through-opening and a post is positioned within the guide means, the post is supported by the guide means in a steady condition for being driven into the ground.

A limitation associated with the apparatus of my earlier patent relates to the fact that once the platen base of the apparatus is positioned upon the ground, the orientation of the post which is desired to be driven into the ground relative to the surface of the ground cannot be appreciably altered. In other words, in order to make a significant adjustment in the orientation of a post desired to be driven into the ground once the platen base of my patented apparatus is placed upon the ground, the position of the base will have to be re-adjusted.

Accordingly, it is an object of the present invention to provide a new and improved post support apparatus which is capable of supporting a post while it is being driven into the ground and which accommodates a substantial adjustment in the orientation of a post desired to be driven into the ground without requiring that the base of the apparatus be moved.

Another object of the present invention is to provide such an apparatus which is uncomplicated in structure, yet effective in operation.

SUMMARY OF THE INVENTION

This invention resides in a support apparatus for supporting a post which is to be driven into the ground by an individual wherein the post has a ground-engaging lower end.

The apparatus includes a platen base for resting upon the ground and having an upper surface upon which an individual can stand while the post is being driven into the ground. The base defines a through-opening therein which is located within the upper surface of the base so that when an individual stands upon the upper surface while the post is being driven into the ground, the through-opening is disposed between the feet of the individual. The apparatus further includes guide means for providing an elongated cavity having two opposite ends, wherein the cavity is sized to slidably receive a post inserted end-wise therein. Furthermore, the apparatus includes means for attaching the guide means to the base so that the cavity of the guide means is positionable in registry with the through-opening of the base so that when an individual stands upon the base with his feet disposed on opposite sides of the through-opening and a post is received by the cavity so that the lower end of the post engages the ground through the through-opening of the base, the post is supported by the guide means in a steady condition for being driven into the ground.

The attaching means permits the guide means to be rotated in position relative to the platen base to accommodate a rotational adjustment in position of a post which is supported by the guide means without requiring that the position of the platen base be altered, and the cavity of the guide means is at least about twelve inches in length to enhance the steadiness of the post positioned within the guide means.

DETAILED DESCRIPTION OF AN ILLUSTRATIVE EMBODIMENT

Figure 1:
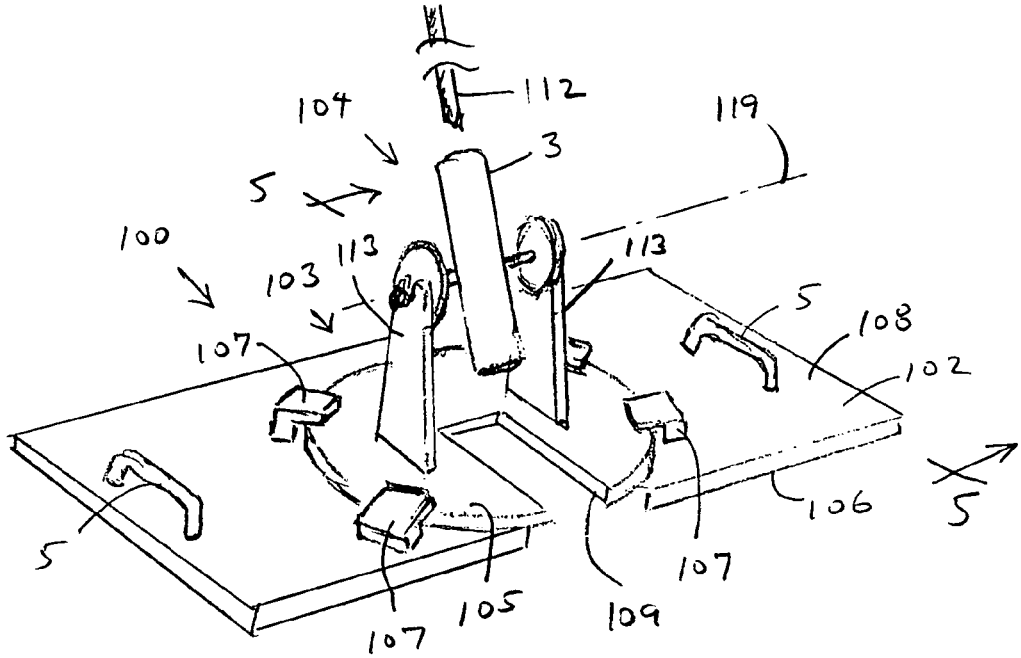
FIG. 1 is a perspective view of an embodiment of the support apparatus within which features of the present invention are incorporated.

Turning now to the drawings in greater detail and considering first FIG. 1, there is illustrated an embodiment, generally indicated 100, of a support apparatus within which features of the present invention are incorporated. The support apparatus 100 includes a platen base 102 which rests upon the ground and guide means, generally indicated 104, which cooperates the base 102 for supporting a post, such as a t-post, in a steady condition while the post is being driven into the ground. The apparatus 100 also includes means, generally indicated 103, for rotatably supporting the guide means 104 atop the platen base 102 to accommodate a change in rotational position of the guide means 104, and hence a post supported by the guide means 103, relative to the platen base 102.

The class of post with which this invention is concerned is preferably constructed of steel and has a lower end which is adapted to be driven into the ground while its opposite, or upper, end is pounded upon with a sledge hammer or comparable driver or driving tool. Accordingly, the post is designed to withstand repeated impact as its upper end is repeatedly struck with a driver as the post is being driven into the ground. In addition, such a post may be provided with a T-shaped, U-shaped, square, round or cross(+)-shaped cross section, although posts having alternative cross-sectional shapes can be had.

The posts which have a T-shaped cross-section are referred to herein as t-posts and are commonly used on a farm to support wire fences for containing livestock. Compared to the installation of posts having large cross-sectional areas, the installation of t-posts is relatively easy. Heretofore, however, the installation of t-posts usually require two people wherein one person is required to hold the post in a steady condition while the other person pounds upon the post with a driving tool. It is very difficult for one person to drive a post by himself because he would have to use one hand to hold the post steady while at the same time use the other hand to drive the post into the ground. The present invention is designed so that one person can drive a t-post into the ground without assistance from another person. Therefore, the apparatus 100 is advantageous in that it permits a single individual to drive a post into the ground without the aid of another individual for holding the post steady as the post is being driven into the ground.

Figure 2:
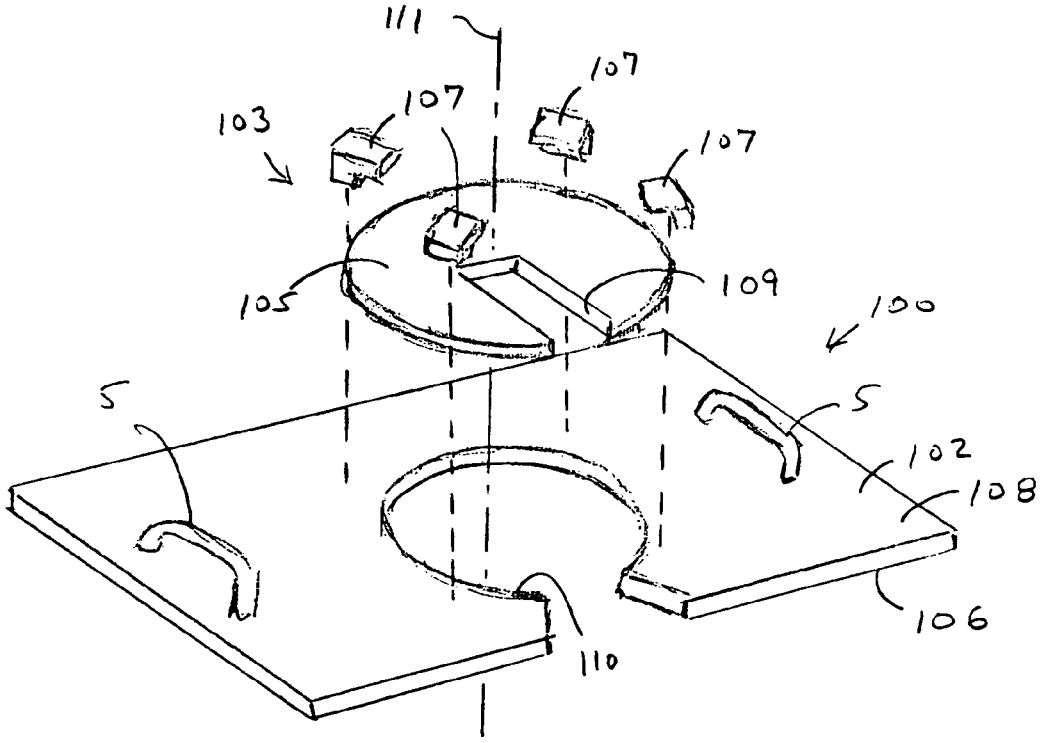
FIG. 2 is a perspective view of a fragment of the FIG. 1 embodiment, shown exploded.

With reference to FIGS. 1 and 2, the platen base 102 has a lower surface 106 which rests upon the ground when the apparatus 100 is being used and has an upper surface 108 upon which an individual can stand as the post is being driven into the ground. In addition, the base 102 defines a through-opening 110 (best shown in FIG. 2) which extends between the upper and lower surfaces 106 and 108 of the base 102. The through-opening 110 is located along the upper surface 108 of the base 102 so that when an individual stands with his feet upon the base 102 for use of the apparatus 100, the individual's feet are disposed on opposite sides of the through-opening 110. The plate 102 is preferably constructed of steel, but other materials can be used.

Although the FIG. 1 embodiment 100 and, more particularly, its base 102 is adapted to be stood upon by an individual while the embodiment 100 is being used to drive a post into the ground, it is not necessary for an individual to stand upon every embodiment which incorporates features of the present invention during use of the embodiment. For example, an embodiment could be heavy enough to easily support a post in a stable condition for driving purposes without the user being required to stand upon the base of the embodiment (and thereby add his weight to the embodiment) to adequately stabilize the embodiment during use. In fact, the design and/or shape of an embodiment can render it difficult for the user to stand upon the embodiment base during a post-driving operation. Accordingly, it will be understood that it is not always necessary for a user to stand upon the base of an embodiment in order for the embodiment to be used.

In the interests of the present invention, the term "through-opening" is intended to mean any opening provided in the base through which a post desired to be driven into the ground is permitted to pass and can include, for example, a circular-shaped opening provided with a notch which opens along the side edge of the base (such as the opening 110 of the apparatus 100). Upon completion of a post-driving operation, a base whose through-opening is provided by a notch may be simply withdrawn sideways from a post whereas a through-opening which is provided by a circular hole will likely require that the base be bodily lifted up and over the post to remove the base from the post.

To facilitate the transport of the FIG. 1 apparatus 100 between sites, the apparatus 100 includes a pair of handles 5 which are attached to the base 102 along the upper surface 108 thereof and on opposite sides of the through-opening 110. Preferably, the handles 5 are spaced far enough away from the through-opening 110 so that each foot of an individual who uses the apparatus 100 can be positioned between the through-opening 110 and the handle 5 which is positioned to one (i.e. the corresponding) side of the through-opening 110.

Figure 3:
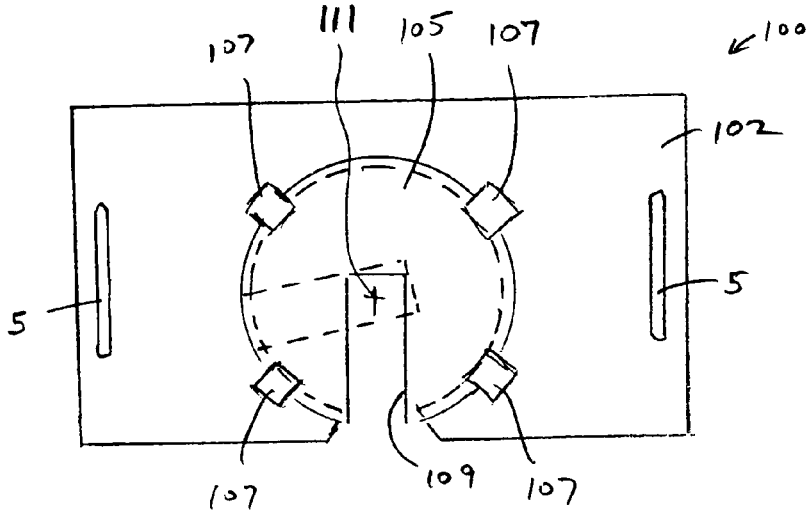
FIG. 3 is a plan view of the fragment of FIG. 2, shown assembled and as seen from above in FIG. 2.

It is a feature of the embodiment 100 that its guide mean 104 is supported atop the platen base 102 in a manner which permits rotation of the guide means 104 relative to the base 102 to alter the position of the guide means 104, and hence a post supported by the guide means 104, relative to the base 102. To this end, the rotatable support means 103 includes a substantially circular tray member 105 having a notch 109 opening out of one side thereof, and the tray member 105 is rotatably secured to the base 102 across the opening 110. For securing the tray member 105 across the opening 110, the apparatus 100 includes a set of L-shaped pillow blocks 107, or clamps, which are each possess substantially an L-shaped cross section and which are positioned about the circumference of the tray member 105 and secured, as with screws, to the base 102. In this connection, the pillow blocks 107 are arranged upon the base 102 so that the legs thereof collectively define a circular guide channel within which the tray member 105 is permitted to slidably rotate. In other words, with the tray member 105 positioned upon the base 102 and the pillow blocks 107 secured in position upon the base 102 so that one leg of each pillow block 107 extends over the edge of the tray member 105, the tray member 105 is captured upon the base 102, yet is free to be rotated about an axis, indicated 111 in FIGS. 2 and 3, which is substantially perpendicular to the plane of the base 102 and which extends through the approximate center of the tray member 105.

Figure 4:
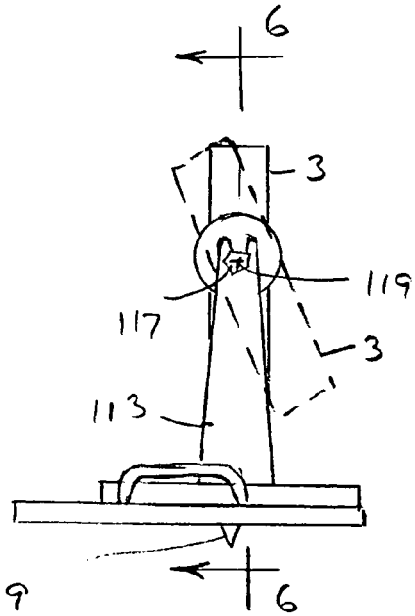
FIG. 4 is an elevational view of the FIG. 1 embodiment, as seen generally from the left in FIG. 1.

With reference to FIGS. 1 and 4, the guide means 104 includes a member, described herein, which provides an elongated cavity having two opposite ends wherein the cavity is sized to slidably receive a post, such as a t-post 112 or FIG. 1, inserted endwise therein and so that when inserted therein, the surfaces of the post are closely spaced to the inside surfaces of the cavity. In the depicted embodiment 100, the cavity is provided by the interior of a hollow cylinder or shaft 3 which extends between the opposite ends of the shaft 3. Furthermore, the shaft 3 is arranged in such a relation to the platen base 102 that its cavity is positionable in registry with the through-opening 110 of the plate 102. Therefore, when a post is inserted endwise through the cavity of the shaft 3, the lower end of the post is engageable with the ground through the through-opening 110 of the platen base 102. To enhance the capacity of the guide means 104 to steady the post as it is being driven therethrough, the cavity provided by the guide means 104 is at least twelve inches in length, and the cavity of the shaft 3 includes a cross section which is shaped complimentary to the cross-sectional shape of the post received thereby.

In the depicted FIG. 1 embodiment 100, the shaft 3 is pivotally joined to a pair of pedestals 113 which are, in turn, fixedly secured atop the tray member 105. In this connection, the pedestals 113 are each fixed upon the base 102 and on opposite sides of the center of the tray member 105, as best viewed in FIG. 1.

Figure 5:
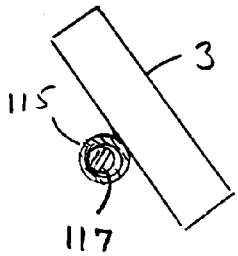
FIG. 5 is a fragmentary cross-sectional view taken about along line 5—5 of FIG. 1.

For securement of the shaft 3 to the pedestals 113, there is provided a sleeve 115 (FIG. 5) which is secured to the shaft 3, and the shank of a bolt 117 is slidably received by the sleeve 115. More specifically, the shaft 3 is secured, as with welds, to the outer surface of the sleeve 115 adjacent the center thereof. Meanwhile, the opposite ends of the bolt 117 are positioned so as to rest across upwardly-opening notches provided in the upper end of the pedestals 113 so that the shaft 3 is supported across the spacing provided between the pedestals 113. It follows that with the shaft 3 supported across the pedestals 113 in this manner, the shaft 3 is permitted to pivot relative to the pedestals 113 between, for example, the position illustrated in solid lines in FIG. 4 and the position illustrated in phantom in FIG. 4 about an axis, indicated 119 in FIGS. 1 and 4, which is arranged substantially parallel to the plane of the platen base 102 and is coincident with the longitudinal axis of the bolt 117.

Figure 6:
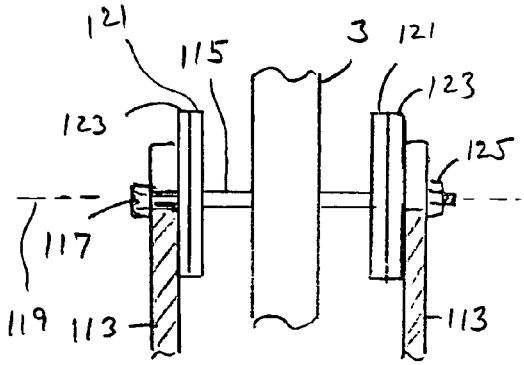
FIG. 6 is a fragmentary cross-sectional view taken about along line 6—6 of FIG. 4.

The shaft 3 can be held in a desired pivotal position relative to the pedestals 113 by way of a number of different means or methods. However, in the depicted embodiment 100 and as best shown in FIG. 6, there is arranged upon the sleeve bolt 115 and at each end thereof a pair of discs 121, 123 wherein each disc has a side surface with radially-extending grooves defined therein and wherein the discs 121, 123 are arranged so that the grooved sides of the disc 121, 123 face one another. Furthermore, the discs 121, 123 are arranged inboard of the pedestals 113, and one disc 121 of each set is fixedly secured, as with welds, to the sleeve 115 for rotation therewith. Meanwhile, the other disc 123 of each set is fixedly secured, as with welds, to the corresponding pedestal 113 for rotation therewith.

By loosening a nut 125 which is threadably secured upon the end of the bolt 117 opposite the head end, the shaft 3 (and associated discs 121) can be pivoted about the pivot axis 119 relative to the pedestal 113 (and associated discs 123) to position the shaft 3 at a desired pivotal relationship relative to the base 102 and so that the rotational position of each disc 121 relative to its opposite disc 123 is altered. At that point, the nut 125 can be re-tightened upon the bolt 117 so that the facing pairs of discs 121, 123 mesh with one another and thereby lock the shaft 3 in a fixed pivotal position relative to the pedestals 113. For a more detailed description of the grooved disc system with which the shaft 3 can be releasably locked in alternative pivotal positions relative to the base 102, reference can be had to my earlier U.S. Pat. No. 6,719,261, the disclosure of which is incorporated herein by reference.

It follows from the foregoing that the shaft 3 can be pivoted relative to the base 102 and releasably locked in alternative angular positions relative to the base 102 by way of the sets of grooved discs 121, 123 and that the rotational position of the shaft 3 can be altered by rotating the rotatable tray member 105 to alternative rotational positions relative to the base 102. Such capabilities are advantageous in that once the base 102 is positioned upon the ground at a location at which a post 112 is desired to be driven with the apparatus 100, the position of the shaft 3 relative to the underlying base 102 can be significantly altered, as desired, without the need to move the base 102. For example, if the underlying ground is not level, the base 102 will not normally be horizontal when placed thereon. Consequently, the shaft 3 may need to be re-oriented (by appropriate rotation of the tray member 105 relative to the base 102 or by appropriate pivoting of the shaft 3 relative to the base 102) to position the shaft 3, and more particularly, a post 112 supported thereby to a desired orientation in relation to the underlying ground. In any event, the apparatus 100 accommodates a significant adjustment in position of the shaft 3 relative to the base 102, and the apparatus 100 is advantageous in this respect.

It follows that an apparatus 100 has been described which enables an individual to drive a post into the ground. More specifically and to use the apparatus 100, the base 102 is positioned upon the ground so that the opening in the base 102 is positioned over a location at which a post is desired to be driven, and then an individual inserts a post (e.g. a t-post 112) into the cavity of the shaft 3 so that lower end of the post engages the ground through the notch 109 of the tray member 105 and the through-opening 110 of the base 102. The shaft 3 is then re-oriented, as necessary, by either rotating the tray member 105 relative to the base 102 or altering the angular orientation of the shaft 3 relative to the base 102 to alter the orientation of the post 112 relative to the underlying ground, and then the individual can stand upon the base 102 with his feet positioned on opposite sides of the through-opening 110. With the post 112 supported within the shaft 3 in this manner, the base 102 and post 112 are prevented from shifting laterally with respect to the ground and both hands of the individual are free to pound the post into the ground with a driver as the post is supported in a steady condition within the guide means 104. It follows that as the post is driven into the ground by the individual, the post is free to slide downwardly through the cavity of the shaft 3.

Upon completion of a post-driving operation, the nut 125 is loosened from the bolt 117 the shaft 3 (and attached sleeve 115 and bolt 117) can be lifted from the pedestals 113 and up and over the post without also having to lift the weight of the base 102 with that of the shaft 3. If the through-opening of the base 102 is a circular opening, then the base 102 will also have to be lifted up and over the post, but if the through-opening includes a notch which opens out of a side edge of the base (like that of the opening 110 of the base 102), the base 102 can be removed from the post by sliding the base sideways as the notch is guided along the post.

If desired, the base 102 can be stabilized by providing the apparatus 100 with anchor means, generally indicated 132 (FIG. 4), for holding the base 102 firmly in place against the ground. In the depicted embodiment 100, the anchor means 132 is in the form of protrusions 9, such as downwardly-extending spikes, which are joined to the lower surface of the base 132 and are adapted to sink into the ground when the base 132 is stepped upon by the user to anchor the base 102 and thereby minimize its side-to-side movement.

The advantage provided by an apparatus having a removable shaft is that the apparatus can, with the aid of shafts having cavities of alternative cross-sectional shapes, accommodate more than one shape of post using the same steadying plate. Fencing is not the only application for metal posts. For example, it is common to use posts to erect road signs or support utility meters or for other support purposes. The same invention can be used by a single worker having nothing more in his truck than the post, the support, and the driver. Sign posts have cross sections which are not normally shaped like a "T", but rather like a "U", or are even square or round in cross section. A variation of an embodiment which includes a plate and a shaft which are separable from one another is one in which the plate and shaft are fixedly attached to one another. Furthermore, a plate which can be detached from a shaft could be constructed to accommodate more than one type of shaft depending upon the cross-sectional shape of the post. For example, a single plate can be used to alternatively hold shafts intended to accept posts having a T, square, round or U-shaped cross section.

A person skilled in the art could think of many uses that have not been set forth in this document.

Exemplary dimensions of the embodiment are provided here as follows: The platen base 102 measures about 24 inches in length and 11.25 inches in width; the circular portion of the through-opening 110 has a radius of about 4.25 inches and its center is positioned about 6.625 inches from the rear of the base 102; the handles 5 are between about 3 and 4 inches in length; the tray member 105 has a radius of about 4.75 inches in length; and its notch 109 is about 2.5 inches in width and 4.75 inches in depth; and each of the pedestals 113 has a height which measures about 6.56 inches and a tapering width which measures about 3.25 inches across its base and measures about 2 inches across its top. Meanwhile, the notch provided at the top of each pedestal 113 is about 1.5 inches in depth and about 0.5 inches across; and pedestals are arranged about 3.625 inches apart.

It will be understood that numerous modifications and substitutions can be had to the aforedescribed embodiments without departing from the spirit of the invention. For example, the embodiment 100 could include a built-in level so that the true vertical, or other desired angles, could be easily detected. Accordingly, the aforedescribed embodiments are intended for the purpose of illustration and not as limitation.

What is claimed is:

1. An apparatus for supporting a post which is to be driven into the ground by an individual wherein the post has a ground-engaging lower end, the apparatus comprising:

a platen base for resting upon the ground and having an upper surface upon which an individual can stand while the post is being driven into the ground, the base defining a through-opening therein which is located within the upper surface of the base so that when an individual stands upon the upper surface while the post is being driven into the ground, the through-opening is disposed between the feet of the individual;

guide means for providing an elongated cavity having rigid walls and two opposite ends, the cavity being sized to slidably receive a post inserted end-wise therein; and attaching means interposed between the guide means and the platen base for attaching the guide means to the base so that the cavity of the guide means is positionable in registry with the through-opening of the base so that when an individual stands upon the base with his feet disposed on opposite sides of the through-opening and a post is received by the cavity so that the lower end of the post engages the ground through the through-opening of the base, the post is supported by the guide means in a steady condition for being driven into the ground;

the guide means being pivotally attached to the attaching means to accommodate a pivotal adjustment of the guide means relative to the platen base between one condition at which the cavity of the guide means is oriented substantially normal to the platen base and another condition at which the cavity of the guide means is oriented in a non-normal angular relationship with the platen base;

the through-opening of the platen base is disposed in such a relationship to the guide means that the through-opening is maintained in registry with the cavity of the guide means as the guide means is pivotally adjusted between said one and another conditions; and means for releasably locking the guide means in a fixed position relative the attaching means when the guide means is positioned in a non-normal angular relationship relative to the platen base; and wherein the attaching means includes rotatable means which is adapted to be rotated relative to the platen base about an axis of rotation which is oriented substantially perpendicular to the platen base to permit the guide means to be rotated in position relative to the platen base about said axis of rotation while the guide means is fixedly positioned in a non-normal angular relationship relative to the platen base to accommodate a rotational adjustment in position of a post which is supported by the guide means in a non-normal angular relationship relative to the plate base without requiring that the position of the platen base be altered; and the cavity of the guide means is at least about twelve inches in length to enhance the steadiness of the post positioned within the guide means.

2. The apparatus as defined in claim 1 wherein the rotatable means of the attaching means includes a rotatable member upon which the guide means is mounted for pivotal movement with respect to the platen base and which is rotatably secured to the platen base for rotation about said axis of rotation to thereby accommodate an adjustment in rotational position of the guide means relative to the platen base.

3. The apparatus as defined in claim 2 wherein the rotatable means includes means associated with the platen base for providing a circular guide track and wherein the rotatable member cooperates with the circular guide track so that as the rotatable member is rotated relative to the platen base, the rotatable member rotates in the circular guide track.

4. The apparatus as defined in claim 1 wherein the guide means is attached to the rotatable means for pivotal movement relative thereto about an axis of pivot which is oriented substantially parallel to the platen base and which is spaced above the platen base when the base is positioned upon the ground for use.

5. The apparatus as defined in claim 2 wherein the rotatable member is in the form of a circular tray member.

6. An apparatus for supporting a post desired to be driven into the ground by an individual wherein the post has a lower end which is engageable with the ground for being driven therein during a post-driving operation and an opposite upper end which is impacted by a driving tool as the post is being driven into the ground, the apparatus comprising:

a platen base having a lower surface which is adapted to rest upon the ground and having an upper surface upon which an individual can stand while the post is being driven into ground, the base defining a through-opening which extends between the upper and lower surface and which is located along the upper surface of the base so that when an individual stands upon the upper surface during a post-driving operation, the feet of the individual are disposed on opposite sides of the through-opening;

guide means for providing an elongated cavity having rigid walls and two opposite ends, the cavity being sized to slidably receive a post inserted endwise therein;

a rotatable member which is rotatably mounted upon the platen base to accommodate an adjustment in rotational position of the rotatable member relative to the platen base about an rotational axis which is substantially perpendicular to the plane of the platen base; and wherein the guide means is supported upon the rotatable member for movement therewith about the rotational axis thereof and so that the cavity of the guide means is positioned in registry with the through-opening of the base so that when an individual stands upon the base with his feet disposed on opposite sides of the through-opening and a post is received by the cavity so that the lower end of the post is positionable against the ground through the through-opening in the base, the post is maintained in a steady condition by the guide means for being driven into the ground;

the guide means further being pivotally attached to the rotatable member to accommodate a pivotal adjustment of the guide means relative to the platen base between one condition at which the cavity of the guide means is oriented substantially normal to the platen base and another condition at which the cavity of the guide means is oriented in a non-normal angular relationship with the platen base;

the through-opening of the platen base is disposed in such a relationship to the guide means that the through-opening is maintained in registry with the cavity of the guide means as the guide means is pivotally adjusted between said one and another conditions; and means for releasably locking the guide means in a fixed position relative to the rotatable member when the guide means is positioned in a non-normal angular relationship relative to the platen base so that the guide means can be rotated in position about said axis of rotation while the guide means is fixedly positioned in a non-normal angular relationship relative to the platen base to thereby accommodate an adjustment in the rotational position of a post supported by the guide means about the axis of rotation without requiring that the position of the platen base be altered; and the cavity of the guide means is at least about twelve inches in length to enhance the steadiness of the post by the guide means and reduce the amount of play which could otherwise exist between the post and the cavity.

7. The apparatus as defined in claim 6 wherein the rotatable member is rotatably secured to the platen base for rotation within a plane which is substantially parallel to the base.

8. The apparatus as defined in claim 7 further including means associated with the platen base for providing a circular guide track and wherein the rotatable member cooperates with the circular guide track so that as the rotatable member is rotated relative to the platen base, the rotatable member rotates in the circular guide track.

9. The apparatus as defined in claim 8 wherein the rotatable member is in the form of a circular tray member.

10. The apparatus as defined in claim 6 wherein the guide means is attached to the rotatable member for pivotal movement relative thereto about an axis of pivot which is oriented substantially parallel to the platen base and which is spaced above the base when the base is positioned upon the ground for use.

11. In an apparatus for supporting a post which is to be driven into the ground by an individual wherein the apparatus includes a platen base for resting upon the ground and upon which an individual stands while the post is being driven into the ground and guide means for providing an elongated cavity sized to slidably receive a post inserted end-wise therein for stably supporting the post as the post is being driven into the ground; the improvement comprising:

means interposed between the platen base and the guide means for attaching the guide means to the base so that the cavity of the guide means is positionable in registry with the through-opening of the base so that when an individual stands upon the base with his feet disposed on opposite sides of the through-opening and a post is received by the cavity so that the lower end of the post engages the ground through the through-opening of the base, the post is supported by the guide means in a steady condition for being driven into the ground;

the elongated cavity of the guide means having rigid walls and the guide means being pivotally attached to the interposed means to accommodate a pivotal adjustment of the guide means relative to the platen base between one condition at which the cavity of the guide means is oriented substantially normal to the platen base and another condition at which the cavity of the guide means is oriented in a non-normal angular relationship with the platen base;

the through-opening of the platen base is disposed in such a relationship to the guide means that the through-opening is maintained in registry with the cavity of the guide means as the guide means is pivotally adjusted between said one and another conditions; and means for releasably locking the guide means in a fixed position relative the interposed means when the guide means is positioned in a non-normal angular relationship relative to the platen base; and wherein the interposed means includes rotatable means which is adapted to be rotated relative to the platen base about an axis of rotation which is oriented substantially perpendicular to the platen base to permit the guide means to be rotated in position relative to the platen base about said axis of rotation while the guide means is locked in a fixed position relative to the platen base when positioned in a non-normal angular relationship relative to the platen base to accommodate a rotational adjustment in position of a post which is supported by the guide means in a non-normal angular relationship relative to the plate base without requiring that the position of the platen base be altered; and the cavity of the guide means is at least about twelve inches in length to enhance the steadiness of the post positioned within the guide means.

12. The improvement as defined in claim 11 wherein the rotatable means of the interposed means includes a rotatable member upon which the guide means is mounted and which is rotatably secured to the platen base for rotation about said axis of rotation to thereby accommodate an adjustment in rotational position of the guide means relative to the platen base.

13. The improvement as defined in claim 12 further including means associated with the platen base for providing a circular guide track and wherein the rotatable member operates with the circular guide track so that as the rotatable member is rotated relative to the platen base, the rotatable member rotates in the circular guide track.

14. The improvement as defined in claim 11 wherein the guide means is attached to the interposed means for pivotal movement relative thereto about an axis of pivot which is oriented substantially parallel to the platen base and which is spaced above the base when ase is positioned upon the ground for use.

* * * * *